United States Patent [19]

Reid et al.

[11] Patent Number: 4,969,292

[45] Date of Patent: Nov. 13, 1990

[54] PET DOORS

[75] Inventors: Alister P. Reid, Lytham; John Kopec, Blackburn, both of England

[73] Assignee: Reilor Limited, Preston, England

[21] Appl. No.: 242,439

[22] Filed: Sep. 9, 1988

[30] Foreign Application Priority Data

Sep. 25, 1987 [GB] United Kingdom ..... 8722627

[51] Int. Cl.[5] ..... E05D 15/48

[52] U.S. Cl. ..... 49/169; 160/180; 160/90

[58] Field of Search ..... 49/168, 169, 170, 171, 49/400; 160/180, 90, D8; 119/1, 19; D25/48, 49

[56] References Cited

U.S. PATENT DOCUMENTS

| | | | |
|---|---|---|---|
| 3,184,803 | 5/1965 | Peel . | |
| 3,464,158 | 9/1969 | Greene . | |
| 3,978,616 | 9/1976 | Pennock . | |
| 4,022,263 | 5/1977 | Beckett et al. . | |
| 4,047,331 | 9/1977 | Davlantes . | |
| 4,224,899 | 9/1980 | Cruchelow . | |
| 4,408,416 | 10/1983 | Davlantes | 49/168 |
| 4,421,058 | 12/1983 | Paul . | |
| 4,480,407 | 11/1984 | Needham et al. . | |
| 4,754,797 | 7/1988 | Sronce | 49/169 |

FOREIGN PATENT DOCUMENTS

| | | |
|---|---|---|
| 796500 | 6/1958 | United Kingdom . |
| 1451615 | 9/1976 | United Kingdom . |
| 1567001 | 5/1980 | United Kingdom . |
| 1576318 | 10/1980 | United Kingdom . |
| 1580537 | 12/1980 | United Kingdom . |
| 2101182 | 1/1983 | United Kingdom . |
| 2119431 | 5/1985 | United Kingdom . |
| 2195690 | 4/1988 | United Kingdom . |

*Primary Examiner*—Kenneth J. Dorner
*Assistant Examiner*—Gerald A. Anderson
*Attorney, Agent, or Firm*—Dority & Manning

[57] ABSTRACT

A pet door has a frame member with a laterally-projecting tunnel formation together defining a portal through which a pet may pass. A flap is located in the portal for closing the portal, the flap being displaceable in one or other of two directions by a pet, to enable the pet to pass through the door in one direction or the other. The tunnel formation provides a ledge which confronts an adjacent opening edge of the flap when the latter is displaced in at least one opening direction, the frame member defining a step down or rebate which disposes the ledge sufficiently spaced away from the adjacent edge of the flap when the flap is displaced in the said direction as to ensure that a pet's paw cannot become trapped and jammed between the flap edge and the ledge.

6 Claims, 3 Drawing Sheets

PET DOORS

This invention relates to improved pet doors.

Pet doors with which this invention is concerned provide portals whereby animals such a cats or dogs may unaided enter or exit a room, or indeed a building such as a house. Pet doors are mounted at an opening usually formed in a conventional door, or formed in a partition, wall or window. Commercially-available pet doors commonly comprise a frame member defining an aperture through which a pet can pass, and an aperture-closing flap swingably mounted in or adjacent the aperture. The flap normally resides in an aperture-closing position but can be readily displaced therefrom by a pet in the course of passing through the pet door. After the pet has passed through, the flap swings back to the closing position of its own accord or aided by suitable biasing means. Most frequently, although not always, the ,flap is top-hung when gravity may urge it into the closing position. A top-hung flap is hinged or pivoted about a substantially horizontal axis located at or somewhere in the vicinity of its top edge.

When pet doors are located to give access to or from the outside, it is desirable that they guard against draughts, heat loss and ingress of rain or snow. In essence, this function is achieved by making the flaps the same shape as the apertures and by minimizing the clearance gaps between flaps and apertures. Sealing means may be fitted to the pet doors to seal these gaps. Plastics magnet strips for instance are used, and they also serve to retain the flaps in the closed position against the effects of wind.

In modern pet doors, the apertures are bounded adjacent "opening" edges thereof, remote from the flap or hinging axes, at least in part by substantially extended margins, shelves or ledges, which are commonly located opposite the flap edge portions furthest from the flap axes. These margins, shelves or ledges, which can constitute thresholds or sills of pet doors, may extend a substantial distance e.g. related to the thicknesses of walls or doors to which the doors may be fitted. Such a margin, shelf or ledge can define part of a compartment which contains a latch arrangement whereby the pet door flap can be selectively secured or released.

We have found that the snug interfit between the flaps and apertures of modern pet doors in conjunction with the said margins, shelves or ledges has a serious drawback. Pets may be hesitant to pass through a pet door for one reason or another. Often they will push a paw through the door, in the process displacing the flap from its closing position. They may then decide against passing through the door when they will naturally endeavour to retract the paw. Unfortunately, the flap and margin, shelf or ledge will trap the paw therebetween. The harder the pet pulls back its paw, the tighter the flap jams it against the margin, shelf or ledge. This is obviously frightening, and potentially painful, for a pet and in its panic it may well not find that the solution is simply for it to proceed through the pet door. Such an experience for a young animal may discourage it from using the pet door in future.

The principal object of this invention is to devise a practical and effective solution to this paw-trapping problem.

According to the present invention, there is provided a pet door comprising a frame member defining a portal or aperture through which a pet may pass and having a flap swingably mounted in the portal or aperture for opening and closing the latter, the frame member having a laterally projecting ledge or shelf disposed adjacent the portal or aperture and adjacent a free edge of the flap which is remote from means mounting it for swinging movement in the portal or aperture, the ledge or shelf projecting a significant distance in at least one direction of opening movement of the flap, and the ledge or shelf being stepped or rebated to provide an enlarged clearance between it and the said free edge when the flap is displaced in the said one direction, which enlarged clearance serves to prevent trapping of a pet's paw or leg between the flap and ledge or shelf.

The invention will now be described in more detail by way of example only with reference to the accompanying drawings, in which.

Figure 1:
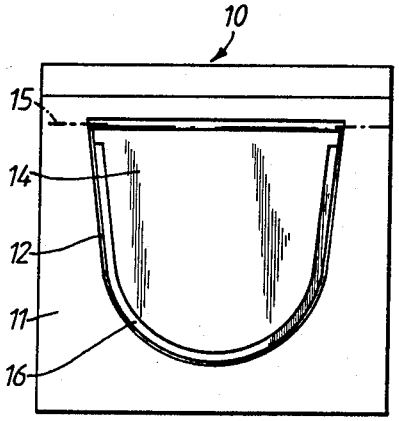
FIG. 1 is a front elevation of a known kind of pet door, which is adaptable according to the principles of the present invention.
Figure 2:
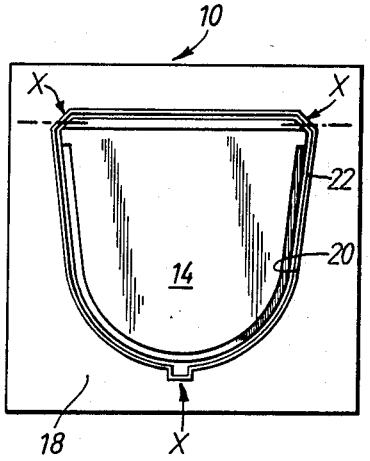
FIG. 2 is a rear elevation of the pet door shown in FIG. 1.
Figure 3:
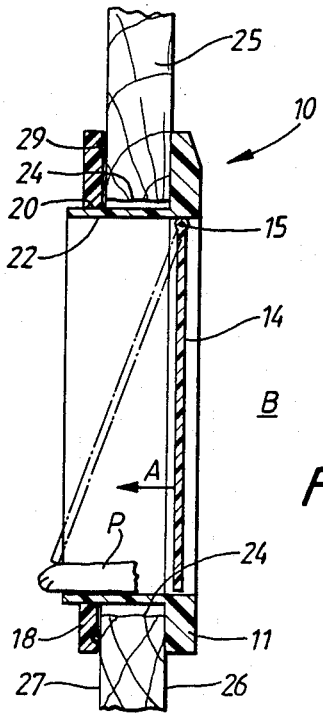
Figure 4:
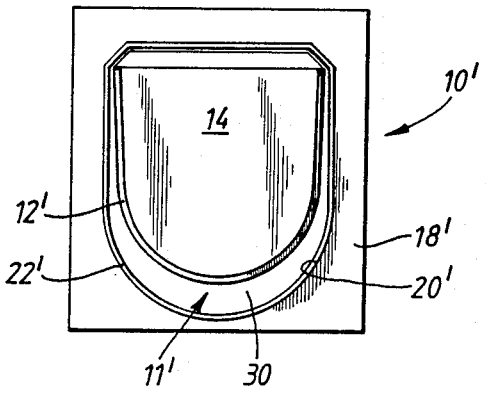
Figure 5:
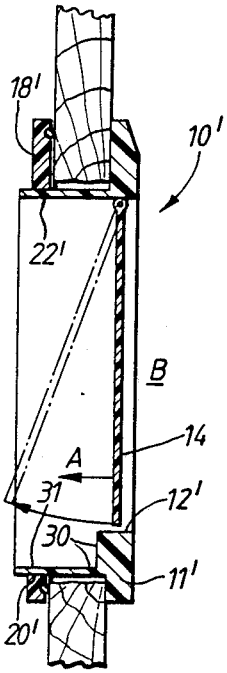
Figure 6:
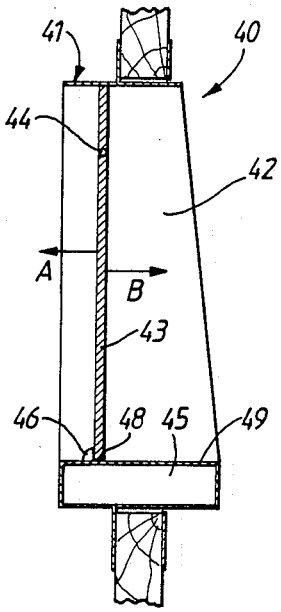
Figure 7:
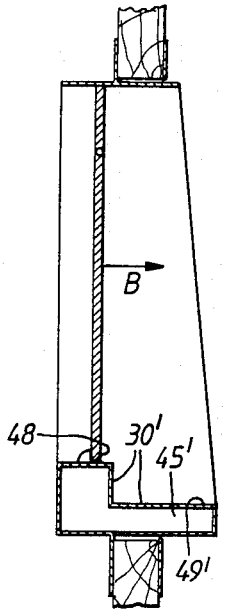
Figure 8:
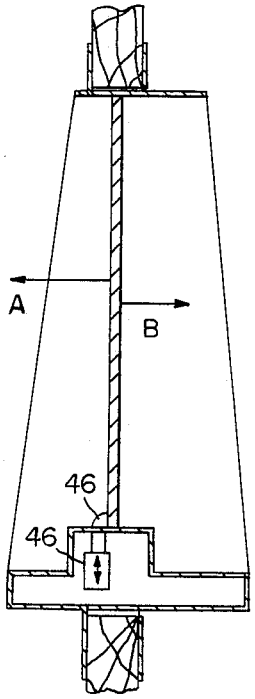

FIG. 3 a is schematic longitudinal or vertical cross-sectional view through the pet door shown in FIGS. 1 and 2, and illustrating the door mounted e.g. in a door of a building;

FIG. 4 is a rear elevation of a first pet door adapted according to the principles of this invention;

FIG. 5 is a vertical cross-section, similar to the illustration of FIG. 3, but of the pet door shown in FIG. 4;

FIG. 6 is a vertical cross-section through another known pet door;

FIG. 7 is a vertical cross-section through the pet door of FIG. 6 after adaptation according to the principles of this invention; and FIG. 8 is a vertical cross-section through an embodiment of the pet door of the present invention including a flap-securing mechanism and stepdowns on either side of the closing position.

The pet door shown in FIGS. 1 to 3 is of known type. The door 10 is manufactured and marketed by Reilor Limited under the RTM STAYWELL as the Model 20 or 21 pet door. The door is described in more detail in our E.P.-B-0 076 026. and U.S. Pat. No. 4,480,407.

Pet door 10 has a main frame member 11 having an aperture 12 defined therein large enough for a pet such as a cat to pass through the door. An aperture-closing flap 14 is top-hung in the aperture to swing about a horizontal axis 15 adjacent its top edge. Being top-hung, the flap 14 naturally swings under gravity to its closing position after it has been displaced by a pet and after the pet has passed through the door 10. To minimize draughts, the flap 14 is a close fit in the aperture 12. Moreover, a sealing strip (not shown) is mounted in a channel 16 formed along a substantial part of the periphery of the flap, and/or possibly of the aperture Such a strip of the flap is, for example a plastics magnet which coacts with a companion magnet strip (not shown) disposed around the periphery of the aperture 12. The sealing means closes the small clearance gap between flap 14 and aperture 12.

FIG. 1 represents the pet door 10 as seen from one side e.g. the inside when the pet door is fitted to an exterior door, wall or window.

FIG. 2 shows the pet door 10 as seen from the opposite side when a subsidiary frame member 18 is visible. The frame member 18 also has an aperture 20 similar to aperture 12. A tunnel portion 22 of main frame member 11 is received in aperture 20. The tunnel portion 22 projects from a normally non-visible face of frame member 11 and provides a smooth and easily cleaned portal through which a pet can pass. The length of the tunnel is greater than the thickness of most standard doors to which the pet door is likely to be fitted.

The profiles of the apertures 12 and 20, the flap 14 and the tunnel 22 as shown are approximately D-shaped as viewed in elevation. Other shapes are possible, however, for instance square, rectangular or trapezoidal.

As indicated hereinbefore, pet door 10 can be located at an opening provided in a door, wall, partition or window of a building. FIG. 3 shows the manner in which the pet door 10 is fitted e.g. to a door.

An opening 24 large enough to accept the tunnel 22 is cut through the door 25. The opening can be cut quite roughly and need not be carefully finished since it is completely concealed by the pet door 10 when the latter is fitted. The pet door 10 is therefore beneficial for the home handyman who may be short on skill and tools. Once the opening 24 is made, main frame 11 is installed by passing the tunnel 22 through the opening 24, disposing the frame flush against an inside face 26 of the door 25. The tunnel 22 projects beyond the outside face 27 of the door and the subsidiary frame member 18 is then placed on the projecting tunnel portion and disposed flush against the face 27 of the door. Screws (not shown) may be passed through suitable apertures in one of the frame members, through the door 25 or opening 24 and into screw receivers (not shown) in the other frame member for clamping the frame members tightly to the door.

Screw fixing can be eliminated by appropriate design of the pet door. The door 10 shown in FIGS. 1 and 2 is so designed. At several points X around the aperture 20 and tunnel 22 there are interengaging toothed rack formations which are known and which serve to secure the subsidiary frame 18 to the tunnel 22 of the main frame. When fitting the pet door 10 to the door 25 therefore, the two frames are pushed towards one another, the toothed formations riding one over another in the process, until a seal element 29 on at least one of the frame members is squeezed firmly against the door 25. The interfitting toothed rack formations of the aperture 20 and tunnel 22 then retain the pet door firmly clamped to the door.

The clamping arrangement just described is of especial benefit where the pet door has to be fixed to a thin panel or to a window pane.

In this top-hung pet door, remote from the top hinging axis 15 and at the bottom of the portal provided by aperture 12 and tunnel 22, the tunnel forms a margin, shelf or ledge laterally projecting from the frame member 11, the margin, shelf or ledge extending a significant distance in one opening direction A of the flap 14. This margin, shelf or ledge is disposed close to the free edge of the flap remote from the axis 15, i.e. the edge portion at the bottom of the flap. The close fit here can be troublesome because a pet's paw P can become trapped. This happens when a pet pushes the flap open with a paw, and then decides against passing through the pet door 10. See FIG. 3. It tries to retract its paw but due to the flap's mounting and its tendency to return to the closed position, the flap nips the paw between its free edge and the margin, shelf or ledge. The harder the pet tries to pull its paw free, the tighter it is jammed between the flap and the margin, shelf or ledge. This problem is not unique to top-hung pet doors, and could arise with e.g. side hung doors which may be biased to a closed setting. According to the invention, the pet door has been modified to overcome this paw or leg trapping problem. The modified door 10' is shown in FIGS. 4 and 5 to which attention is now directed.

Comparisons of FIGS. 4 and 5 with FIGS. 1 to 3 reveal that the pet doors 10 and 10' are substantially the same except as follows. In door 10', the tunnel 22'' of frame member 11' has been enlarged, or made deeper or lowered. Thus, its portion has remote from the hinge axis been moved significantly below the corresponding portion of opening 12' of frame 11'. Frame member 18' has an aperture 20' with its corresponding o lower portion appropriately lowered to accommodate the modified tunnel 22'. In essence, the frame member 11' and tunnel 22' form a rebate or step-down 30 which is located adjacent to the flap 14 when the latter is in its closing position, the step-down 30 being located on the side of the frame member 11' from which the tunnel 22' projects. The margin, shelf or ledge 31 here presented by the bottom part of the tunnel 22' is thereby located a substantial distance below the bottom edge of the flap 14 when the latter is moved in the opening direction A. The distance by which the margin, shelf or ledge 31 presented by the bottom of the tunnel 22' is spaced below the bottom of opening 12' can, by way of example, be of the order of 2 cm or more. Thanks to the step-down 30 and the spacing of the margin, shelf or ledge 31 below the opening 12', trapping of a pet's paw is now prevented effectively and simply, and with a minimum of redesign of the basic pet door.

Trapping of a pet's paw in pet door 10 only occurs in opening direction A due to the margin, shelf or ledge of tunnel 22 being disposed to this opening side of the closing position. Trapping is not a problem when the flap 14 is opened in the opposite direction (i.e. when the pet approaches the door 10 or 10' from the left as seen in FIGS. 3 and 5). This is because of the absence of any extended margin, ledge or tunnel to the side B of the flap closing position. If a pet door were designed with a margin, shelf, ledge or tunnel extending significant distances in both directions away from the closing position, then stepdowns 30 would, in accordance with this invention, be provided one on either side of the closing position to render the pet door trap-proof in both opening directions. FIG. 8 illustrates a pet door in accordance with the present invention having stepdowns on either side of the closed position.

For ease of illustration, frame members 11, 11', 18, 18' are shown as solid in FIGS. 3 and 5. In fact, they will not usually be solid, and members 11, 11' will define internal compartments containing, for example, devices for latching or locking the flap in a closed position. Such compartments may include electric or electronic circuitry and electric power sources for suitably unlocking a flap; such circuitry is already known in various forms and will not be described further herein. However, FIG. 8 schematically illustrates one such flap-securing mechanism 46 in accordance with the present invention. The frame and flap components can be plastics and the flap components are preferably transparent.

Another example of a pet door which may suffer from the paw-trapping problem is shown in GB-B-1,567,001 and which is illustrated in present FIG. 6. Pet door 40 has a frame generally indicated at 41 defining a through opening 42 in which a top-hung flap 43 is pivoted at 44. Immediately beneath the bottom, free edge of the flap 43 the frame 41 of door 40 has a compartment 45 containing a latch mechanism a part 47 of which is visible. The latch mechanism prevents the door flap opening in direction A, e.g. inwards, unless suitable circuitry (not shown) is activated to release the latch. The mechanism freely allows the door flap to open e.g. outwardly in the opposite direction B. As in the case of pet door 10 of Pigs. 1 to 3, there is a risk that a pet's paw might be trapped between bottom edge 48 of the flap and the shelf or ledge formed by the top surface 49 of the compartment 45, if the pet commences opening the flap 43 in direction B and then changes its mind.

Modified pet door 40′ shown in FIG. 7 overcomes this potential problem by altering the top surface 49′ of compartment 45′ so as to include a step down 30′. Adequate space can thus be provided between the bottom edge 48 of flap 43 and surface 49′ to guard against paw trapping when the flap is opened in direction B.

It will be appreciated that the invention can be embodied in pet door designs other than those exemplified herein.

We claim:

1. A pet door, comprising:

a frame member defining an aperture through which a pet may pass;

a flap swingably mounted at an upper portion of said aperture for the opening and closing thereof; and a tunnel formation associated with said frame member and projecting laterally therefrom in at least one direction of opening movement of said flap, said tunnel formation including a marginal portion located adjacent a free edge of said flap and extending laterally therefrom, said marginal portion of said tunnel formation being stepped to provide an enlarged clearance between said tunnel and said flap when said flap is displaced in said at least one direction thereby precluding trapping of a pet's paw between said flap and said marginal portion of said tunnel formation.

2. A pet door according to claim 1 wherein said tunnel formation forms a part of said frame.

3. A pet door according to claim 1 wherein said flap is rigid.

4. A pet door according to claim 1 wherein the compartment accommodates a flap-securing mechanism.

5. A pet door according to claim 1 wherein the recessed marginal portion provides two step-downs, located one to either side of a flap closing position, and thereby providing two clearances to prevent paw trapping when the flap is displaced for opening the door in either direction relative to the closing position.

6. A pet door, comprising:

a frame member defining an aperture;

a rigid flap swingably mounted at an upper portion of said aperture for the opening and closing thereof;

a flap securing mechanism; and a tunnel formation associated with said frame member and projecting laterally therefrom, said tunnel formation including a marginal portion located adjacent a free edge of said flap and extending laterally therefrom, said tunnel formation being stepped to provide an enlarged clearance between said tunnel and said flap when said flap is displaced into said tunnel thereby precluding trapping of a pet's paw between said flap and said tunnel formation.

* * * * *